US010704560B2

(12) United States Patent
Aker et al.

(10) Patent No.: US 10,704,560 B2
(45) Date of Patent: Jul. 7, 2020

(54) PASSIVE CLEARANCE CONTROL FOR A CENTRIFUGAL IMPELLER SHROUD

(71) Applicant: Rolls-Royce Corporation, Indianapolis, IN (US)

(72) Inventors: Grace Aker, Indianapolis, IN (US); Michael Nesteroff, Indianapolis, IN (US); Mark Eric Whitlock, Zionsville, IN (US); Cassandra Cummings, Indianapolis, IN (US); Jonathan Acker, Westfield, IN (US); Younes Khamliche, Carmel, IN (US); Nathanael Cooper, Avon, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 204 days.

(21) Appl. No.: 16/007,647

(22) Filed: Jun. 13, 2018

(65) Prior Publication Data

US 2019/0383304 A1 Dec. 19, 2019

(51) Int. Cl.
*F04D 29/16* (2006.01)
*F04D 29/02* (2006.01)
(Continued)

(52) U.S. Cl.
CPC ..... *F04D 29/162* (2013.01); *F04D 29/023* (2013.01); *F04D 29/4206* (2013.01);
(Continued)

(58) Field of Classification Search
CPC .. F04D 29/162; F04D 29/023; F04D 29/4206; F04D 29/622; F04D 29/624;
(Continued)

(56) References Cited

U.S. PATENT DOCUMENTS 3,085,398 A * 4/1963 Ingleson ..... F01D 11/22 415/127
4,069,662 A 1/1978 Redinger et al.
(Continued)

FOREIGN PATENT DOCUMENTS

JP 02042197 A 2/1990
WO 2014/053722 A1 4/2014

OTHER PUBLICATIONS

European Search Report, dated Oct. 25, 2019, in EP Application No. 19177569.1.

*Primary Examiner* — Ninh H. Nguyen
*Assistant Examiner* — Behnoush Haghighian
(74) *Attorney, Agent, or Firm* — Barnes & Thornburg LLP

(57) ABSTRACT

A centrifugal impeller shroud assembly has a dynamically moveable impeller shroud for encasing a rotatable centrifugal impeller and resolving misalignment between the impeller shroud and the rotatable centrifugal impeller. The assembly comprises a static casing, an impeller shroud, a shroud arm, and a thermal member. The shroud arm is coupled between the casing and the impeller shroud. The thermal member is coupled to the impeller shroud and has a coefficient of thermal expansion (CTE) lower than the CTE of the shroud. The shroud arm comprises a flexible portion configured to flex responsive to a differential pressure across the shroud arm.

20 Claims, 5 Drawing Sheets

(51) Int. Cl.

| | |
|---|---|
| ***F04D 29/42*** | (2006.01) |
| *F01D 11/20* | (2006.01) |
| *F01D 11/08* | (2006.01) |
| *F04D 29/62* | (2006.01) |
| *F01D 11/24* | (2006.01) |
| *F01D 11/16* | (2006.01) |
| *F01D 11/18* | (2006.01) |
| *F01D 11/22* | (2006.01) |

(52) U.S. Cl.
CPC ..... *F01D 11/08* (2013.01); *F01D 11/16* (2013.01); *F01D 11/18* (2013.01); *F01D 11/20* (2013.01); *F01D 11/22* (2013.01); *F01D 11/24* (2013.01); *F04D 29/622* (2013.01); *F04D 29/624* (2013.01); *F05B 2280/50032* (2013.01); *F05D 2300/50212* (2013.01)

(58) Field of Classification Search
CPC ..... F01D 11/08; F01D 11/18; F01D 11/16; F01D 11/24; F05D 2300/50212; F05B 2280/50032
USPC ..... 415/173.1
See application file for complete search history.

(56) References Cited

U.S. PATENT DOCUMENTS 4,247,247 A 1/1981 Thebert
4,264,271 A 4/1981 Libertini
4,472,108 A 9/1984 Pask
4,683,716 A 8/1987 Wright et al.
4,844,688 A 7/1989 Clough et al.
5,017,088 A 5/1991 Miraucourt et al.
5,018,942 A 5/1991 Ciokajlo et al.
5,049,033 A 9/1991 Corsmeier et al.
5,116,199 A 5/1992 Ciokajlo
5,211,534 A 5/1993 Catlow
5,263,816 A * 11/1993 Weimer ..... F16C 39/06 415/131
5,344,284 A 9/1994 Delvaux et al.
5,427,498 A 6/1995 Lehe et al.
6,273,671 B1 * 8/2001 Ress, Jr. ..... F01D 5/043 415/1
6,543,992 B2 4/2003 Webster
6,877,952 B2 4/2005 Wilson
6,935,836 B2 8/2005 Ress, Jr. et al.
7,079,957 B2 7/2006 Finnigan et al.
7,114,914 B2 10/2006 Gendraud et al.
7,165,937 B2 1/2007 Dong et al.
7,189,057 B2 3/2007 Lee
7,448,849 B1 11/2008 Webster et al.
7,575,409 B2 8/2009 Dierksmeier et al.
7,686,569 B2 3/2010 Paprotna et al.
7,688,081 B2 3/2010 Webster
7,824,151 B2 * 11/2010 Schwarz ..... F01D 11/08 415/131
8,047,773 B2 11/2011 Bruce et al.
8,087,880 B2 * 1/2012 Karafillis ..... F01D 11/22 415/1
8,105,012 B2 * 1/2012 Anema ..... F04D 27/0238 415/108
8,210,794 B2 * 7/2012 Nolcheff ..... F04D 17/025 415/228
8,534,996 B1 9/2013 Pankey et al.
8,616,827 B2 12/2013 O'Leary
8,721,270 B2 5/2014 Graefe et al.
8,734,090 B2 5/2014 Lewis
8,790,067 B2 7/2014 McCaffrey et al.
8,894,362 B2 11/2014 Fretwell
9,121,302 B2 * 9/2015 Duong ..... F01D 11/22
9,435,218 B2 9/2016 Casavant et al.
9,441,499 B2 9/2016 Casavant et al.
9,587,507 B2 * 3/2017 Ottow ..... F04D 29/622
9,598,971 B2 3/2017 Hasnedl et al.
9,598,975 B2 3/2017 Uskert et al.
9,957,830 B2 5/2018 McCaffrey et al.
10,066,497 B2 9/2018 Duguay
10,113,556 B2 10/2018 Moniz et al.
10,227,879 B2 3/2019 Moniz et al.
10,309,246 B2 6/2019 Miranda
10,323,535 B2 6/2019 Davis et al.
10,329,940 B2 6/2019 Ballard et al.
10,358,933 B2 7/2019 Moxon
2008/0069690 A1 * 3/2008 Ivakitch ..... F01D 5/043 415/213.1
2008/0134659 A1 6/2008 Schwarz et al.
2013/0202428 A1 * 8/2013 Renard ..... F01D 11/08 415/208.1
2016/0084101 A1 3/2016 McCaffrey
2016/0123172 A1 * 5/2016 Mondal ..... F01D 11/025 415/136
2017/0198709 A1 * 7/2017 Moniz ..... F04D 29/4206
2017/0234147 A1 * 8/2017 Moniz ..... F16J 15/164 415/173.1
2018/0023412 A1 1/2018 Rizzi et al.
2018/0038380 A1 2/2018 Morgan et al.
2018/0112550 A1 * 4/2018 Dierksmeier ..... F01D 11/20

* cited by examiner

PASSIVE CLEARANCE CONTROL FOR A CENTRIFUGAL IMPELLER SHROUD

BACKGROUND

Centrifugal impellers are used in turbine machines, such as a centrifugal pump or a centrifugal compressor, to provide high pressure working fluid to a combustor. In some turbine machines, for example, a centrifugal compressor may be used as the final stage in a multi-stage high-pressure gas generator.

FIG. 1 is a simplified cross-sectional view of a centrifugal compressor 100 in a gas turbine engine. The centrifugal compressor 100 comprises a centrifugal impeller 111 and shroud 120. The centrifugal impeller 111 is mounted to a rotatable shaft 116 and has a plurality of blades 112 coupled thereto. The blade 112 extends between an inducer 115 and an exducer 117. The radially-outward surface of each of the plurality of compressor blades 112 comprises a compressor blade tip 113. As the centrifugal impeller 111 rotates, it receives working fluid at a first pressure and ejects working fluid at a second pressure that is higher than the first pressure.

An annular shroud 120 encases the plurality of blades 112 of the centrifugal impeller 111. The gap between a radially inner surface 122 of shroud 120 and the impeller blade tips 113 is the blade tip clearance 140 or clearance gap. Shroud 120 may be coupled to a static portion of the engine casing 131 directly or via a first mounting flange 133 and second mounting flange 135.

Gas turbine engines having centrifugal compressors 100 such as that illustrated in FIG. 1 typically have a blade tip clearance 140 between the blade tips 113 and the shroud 120 set such that a rub between the blade tips 113 and the shroud 120 will not occur at the operating conditions that cause the greatest closure of the blade tip clearance 140. A rub is any impingement of the blade tips 113 on the shroud 120. However, setting the blade tip clearance 140 to avoid blade 112 impingement on the shroud 120 during transients having the greatest closure of the blade tip clearance 140 may result in a less efficient centrifugal compressor 100 because working fluid is able to flow between the blades 112 and shroud 120, thus bypassing the blades 112 by flowing through gap 140. This constitutes leakage. In the centrifugal compressor 100 of FIG. 1, blade tip clearances 140 cannot be adjusted because the shroud 120 is rigidly mounted to the engine casing 131.

It is known in the art to dynamically change blade tip clearance 140 to minimize rub while also reducing leakage of the working fluid around the blade tips 113. Several actuation systems for adjusting blade tip clearance 140 during engine operation have been developed. These systems often include complicated linkages, contribute significant weight, and/or require a significant amount of power to operate. Thus, there continues to be a demand for advancements in blade clearance technology to minimize rub while avoiding leakage.

SUMMARY

According to some aspects of the present disclosure, a centrifugal impeller shroud assembly has a dynamically moveable impeller shroud for encasing a rotatable centrifugal impeller and resolving misalignment between the impeller shroud and the rotatable centrifugal impeller. The assembly comprises a static casing, an impeller shroud, a shroud arm, and a thermal member. The impeller shroud faces the rotatable centrifugal impeller and extends from an inlet to an outlet. The shroud arm is coupled between the casing and the impeller shroud. The shroud arm comprises a flexible portion, with the shroud arm and impeller shroud at least partially defining a first cavity in fluid communication with the inlet and a second cavity in fluid communication with the outlet. The flexible portion is configured to flex responsive to a differential pressure between the first cavity and the second cavity. The thermal member is coupled to the impeller shroud proximate the outlet. The thermal member has a coefficient of thermal expansion (CTE) lower than the CTE of the shroud.

In some embodiments flexion of the flexible portion of the shroud arm effects axial movement of the impeller shroud. In some embodiments the flexible portion of the shroud arm comprises a U-shaped cross section when viewed normal to an axis of rotation of the centrifugal impeller. In some embodiments a concave surface of the U-shaped cross section is in communication with the second cavity.

In some embodiments the shroud arm is coupled to the impeller shroud at a knee of the shroud. In some embodiments the second cavity is exposed to fluid at the impeller discharge pressure. In some embodiments the first cavity is exposed to fluid at the impeller inlet pressure.

In some embodiments the thermal member effects deflection of the shroud proximate the outlet, the deflection responsive to changes in temperature. In some embodiments movement and deflection of the shroud resolves misalignment between the shroud and the centrifugal impeller. In some embodiments the thermal member has a CTE substantially the same as the CTE of the centrifugal impeller. In some embodiments the assembly further comprises a static member positioned to limit aft movement of the shroud.

According to another aspect of the present disclosure, a centrifugal impeller shroud assembly has a dynamically moveable impeller shroud for encasing a rotatable centrifugal impeller and resolving misalignment between the shroud and the rotatable centrifugal impeller. The assembly comprises a shroud, a thermal member, and a shroud arm. The shroud extends between a forward end proximate an inlet and an aft end proximate an outlet. The thermal member is coupled to the shroud proximate the aft end of the shroud. The thermal member comprises a material having a lower coefficient of thermal expansion (CTE) than the material of the shroud to thereby effect deflection of the aft end of the shroud responsive to changes in temperature. The shroud arm is coupled between the shroud and a static casing. The shroud arm comprises a flexible portion that flexes responsive to a pressure differential across the shroud arm to thereby effect axial movement of the shroud responsive to changes in the differential pressure across the shroud arm.

In some embodiments the shroud comprises an impeller-facing member and a coupling member extending forward from the impeller-facing member, the thermal member being coupled to the shroud via the coupling member. In some embodiments the assembly further comprises a static member positioned to limit aft movement of the aft end of the shroud. In some embodiments the thermal member comprises one or more of nickel alloy, Inconel, titanium, or low-a steel.

In some embodiments the shroud arm is coupled to the shroud approximate a midpoint between the forward end and the aft end. In some embodiments the flexible portion of the shroud arm comprises a U-shaped cross section when viewed normal to an axis of rotation of the centrifugal impeller. In some embodiments movement and deflection of the shroud resolves misalignment between the shroud and the centrifugal impeller.

According to yet another aspect of the present disclosure, a method of dynamically changing the shape of a shroud encasing a centrifugal impeller is presented. The shroud comprises a boundary member extending from an inlet end to a discharge end. The method comprises deflecting the discharge end of the boundary member responsive to changes in the temperature of the fluid at the discharge end by mounting a thermal member to the shroud proximate the discharge end of the boundary member, the thermal member comprising a material having a coefficient of thermal expansion (CTE) that is lower than the CTE of the boundary member; and axially moving a knee portion of the boundary member responsive to changes in the differential pressure between the fluid at the inlet end and the fluid at the discharge end of the boundary member by coupling the shroud to a static casing via a shroud arm, the shroud arm having a flexible portion configured to flex responsive to a differential pressure between the inlet end and the discharge end of the boundary member.

In some embodiments the method further comprises selecting the material of the thermal member to thereby effect thermal deflection of the discharge end of the boundary member in a manner similar to the thermal expansion of the discharge end of the centrifugal impeller during operation of the centrifugal impeller. In some embodiments the method further comprises selecting the flexion of the flexible portion of the shroud arm to thereby effect axial movement of the knee portion of the boundary member in a similar manner to the axial movement of the centrifugal impeller responsive to changes in the differential pressure from the inlet end to the discharge end of the centrifugal impeller during operation of the centrifugal impeller.

BRIEF DESCRIPTION OF THE DRAWINGS

The following will be apparent from elements of the figures, which are provided for illustrative purposes.

Figure 1:
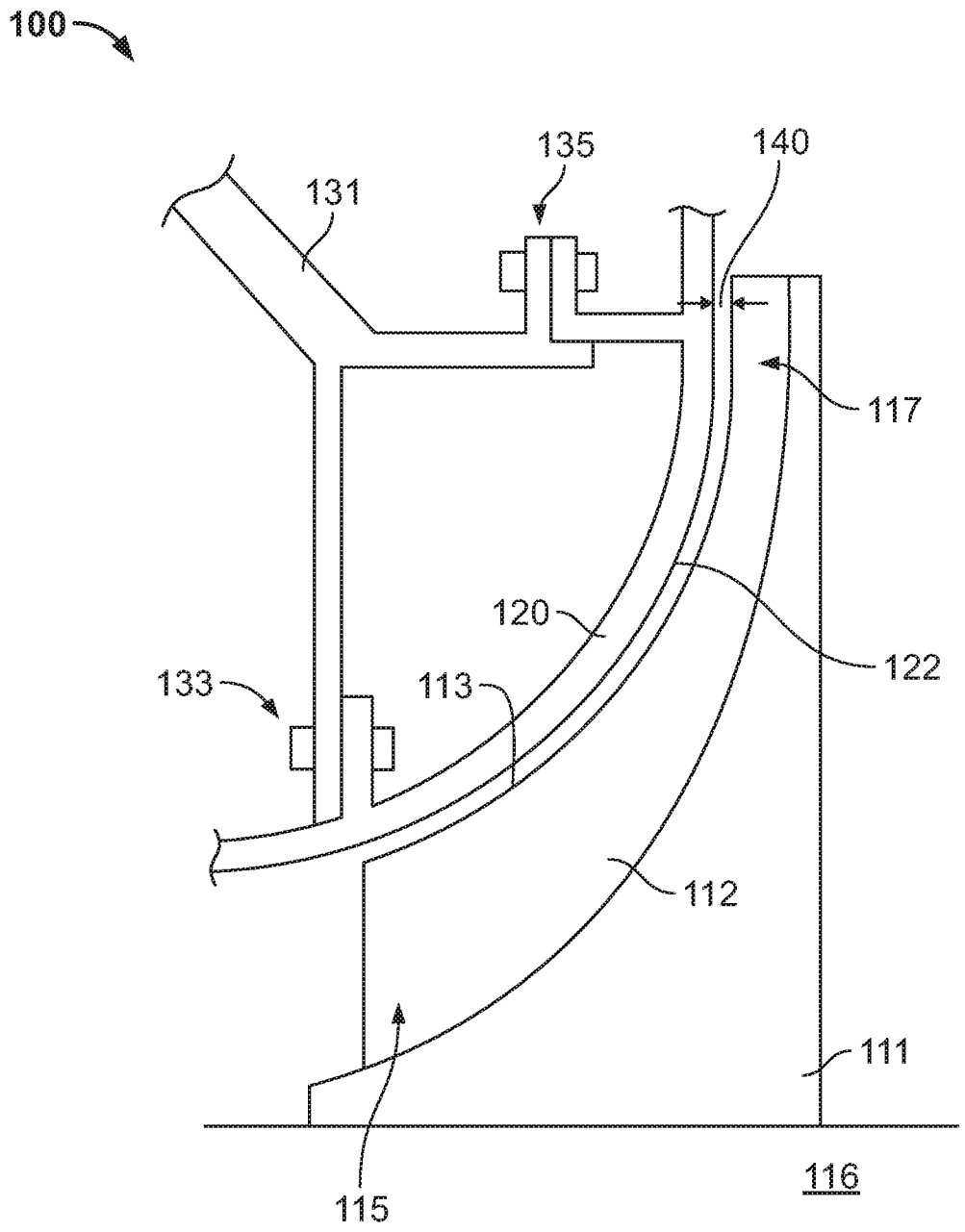
FIG. 1 Prior Art
FIG. 1 is a simplified cross-sectional view of a centrifugal compressor.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments in the drawings and specific language will be used to describe the same.

The present disclosure is directed to maintaining clearance between a centrifugal impeller and a shroud. The present disclosure pertains to many applications of a centrifugal impeller and shroud, such as a centrifugal pump or a centrifugal compressor in a gas turbine engine.

Figure 2:
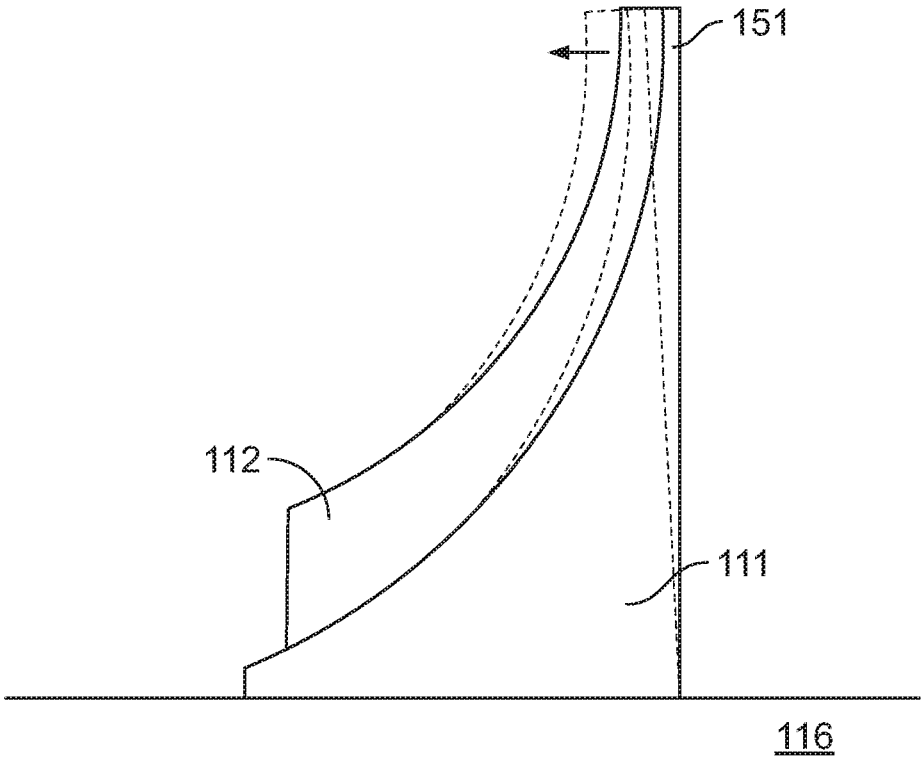
FIG. 2 is a simplified cross-sectional view of the shape change experienced by a centrifugal impeller of a centrifugal compressor during operation.

Maintaining a sufficient clearance gap 140 during operation of the centrifugal compressor 100 is challenging not only due to operational transients, but also because the centrifugal impeller 111 (including blades 112) tends to alter its shape during operation. FIG. 2 provides a simplified cross-sectional view of the shape change experienced by the centrifugal impeller 111 during operation. It should be noted that the shape change illustrated in FIG. 2 is exaggerated for illustration. In FIG. 2, the shape of the centrifugal impeller 111 when not operating is shown in a solid line, and certain of the changes to the shape of the centrifugal impeller 111 while operating are shown in a dashed line.

During operation, the exducer 117 (or outlet end) of the centrifugal impeller 111 curls axially forward from the non-operating position of the exducer 117. This deflection is caused by thermal, mechanical, and pressure loading of the centrifugal impeller 111. The deflection creates a misalignment between the centrifugal impeller 111 and shroud 120.

Existing systems that address the control of an impeller shroud fail to resolve the misalignment between the shroud 120 and centrifugal impeller 111 resulting from operational deflection of the centrifugal impeller 111. As discussed above with respect to FIG. 1, these systems typically include complicated linkages, contribute significant weight, and/or require a significant amount of power to operate. Active control systems also must be programmed to handle operational transients. It is therefore desirable in the art of impeller clearance control to improve the maintenance of the clearance gap 140 during operation of the centrifugal compressor and resolve misalignment between the centrifugal impeller 111 and the shroud 120.

The present disclosure is thus directed to systems and methods of passively maintaining a clearance gap between a shroud and the rotatable blades of a centrifugal impeller, to include maintaining the clearance gap despite deflection of the centrifugal impeller during operation. More specifically, this disclosure presents systems having a thermal member coupled to the aft end of the shroud and a flexible shroud arm extending between a static case and the shroud. As described below, the thermal member and flexible shroud arm cooperate to passively position the shroud relative to the centrifugal impeller to maintain the clearance gap and resolve potential misalignment. This disclosure also presents methods of maintaining a clearance gap and resolving potential misalignment between a centrifugal impeller and shroud.

Figure 3:
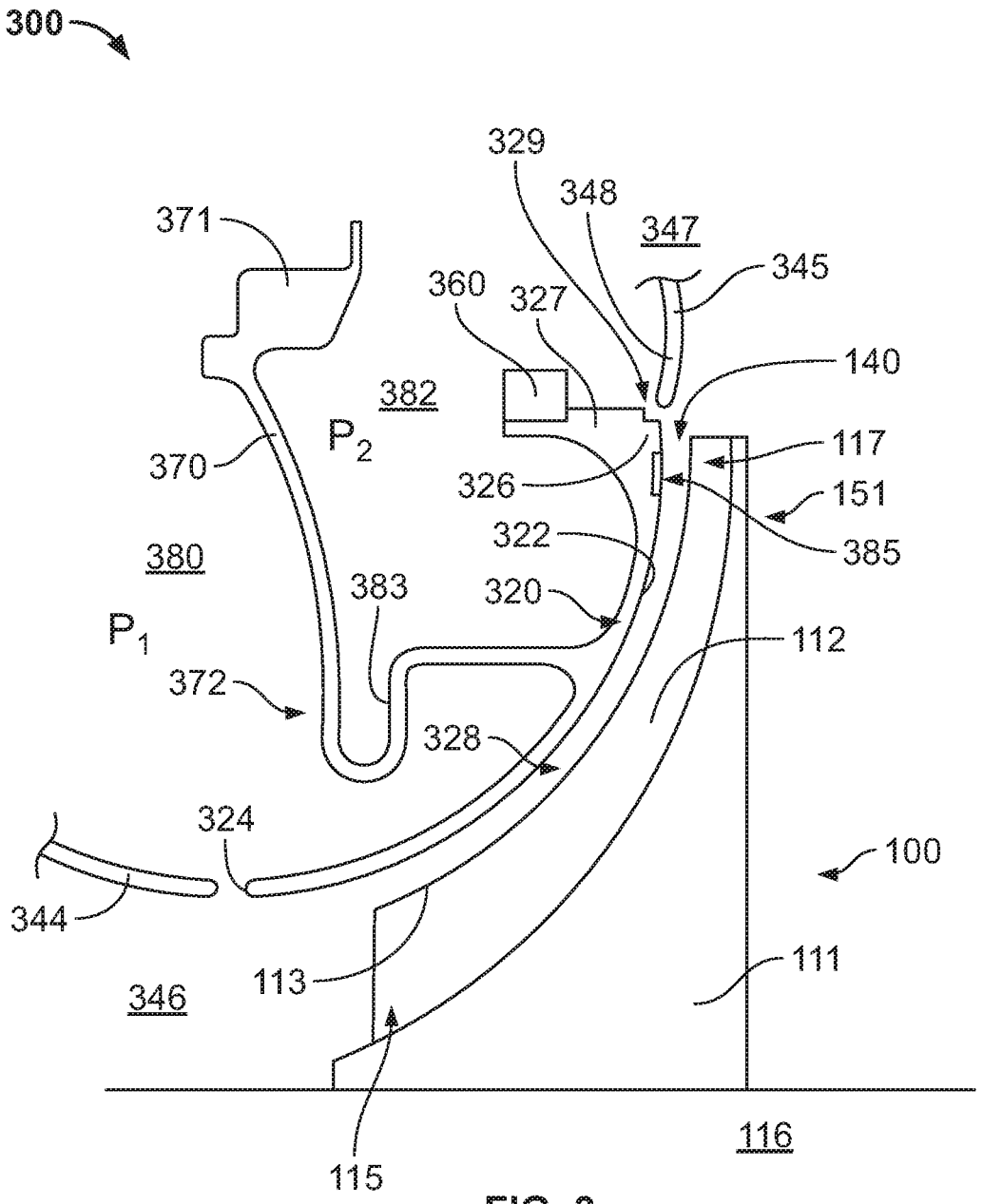
FIG. 3 is a simplified cross-sectional view of a compressor shroud assembly in accordance with some embodiments of the present disclosure.

FIG. 3 provides a simplified cross-sectional view of a centrifugal impeller shroud assembly 300 in accordance with some embodiments of the present disclosure. In some embodiments, a centrifugal impeller shroud assembly 300 may comprise a shroud 320, a thermal member 360, and a shroud arm 370. As applied to a centrifugal compressor, the centrifugal impeller shroud assembly 300 may be referred to as a compressor shroud assembly.

A dynamically moveable shroud 320 extends between an inlet (forward) end 324 and a discharge (aft) end 326. The forward end 324 is proximate the compressor inlet 346 and the aft end 326 is proximate the compressor outlet 347. A central portion of the shroud 320 is referred to as the knee 328 or knee portion. The shroud 320 comprises a boundary member having a radially inner surface 322 that faces the centrifugal impeller 111. The radially inner surface 322 may be referred to as a compressor-facing surface or the impeller-facing surface.

As discussed above, centrifugal compressor 100 comprises a plurality of blades 112 mounted to a centrifugal impeller 111 that is coupled to a rotatable shaft 116. The space between the inner surface 322 of the shroud 320 and the blade tips 113 is referred to as the blade tip clearance 140 or clearance gap.

The shroud 320 is disposed between an inlet flowpath member 344 and an outlet flowpath member 345, which partially define a compressor inlet 346 and compressor outlet 347, respectively. In some embodiments, such as the embodiment illustrated in FIG. 3, the shroud 320 may not be coupled to the inlet flowpath member 344 and the outlet flowpath member 345. In some embodiments, the aft end 326 of the shroud 320 may have a receiving groove 329 configured to receive a portion of the outlet flowpath member 345 called the stop 348. The stop 348 may be a static member configured to prevent axially aft motion of the aft end 326 beyond a predetermined position.

Each of the disclosed components comprises a material having a coefficient of thermal expansion (CTE). The shroud 320 comprises a first material or combination of materials and has a first coefficient of thermal expansion ($\alpha_1$). In some embodiments, the shroud 320 may comprise Inconel, steel, or titanium.

In some embodiments, a thermal member 360 is coupled to the shroud 320 proximate the aft end 326. For example, in the illustrated embodiment a coupling member 327 extends axially forward from the aft end 326 to couple the thermal member 360 to the shroud 320. Thermal member 360 may be one or more hoops or rings, or may comprise more than one member or piece. In some embodiments, thermal member 360 may be integrally formed with the aft end 326, coupling member 327, or shroud 320.

The thermal member 360 comprises a second material or combination of materials and has a second coefficient of thermal expansion ($\alpha_2$). The thermal member 360 may comprise a low thermal expansion material. The thermal member 360 may comprise a material with lower thermal expansion than the shroud 320. In some embodiments, the thermal member 360 may comprise a nickel alloy, Inconel, titanium, or low-a steel. The second coefficient of thermal expansion may be less than the first coefficient of thermal expansion. In other words, the thermal member 360 may be configured to expand less, responsive to increasing temperatures, than the shroud 320.

The shroud 320 is coupled to a portion of the static engine casing 371 by a shroud arm 370. The shroud arm 370 may comprise a flexible portion 372. The flexible portion 372 may have a U-shaped cross section when viewed normal to the axis of rotation. The shroud arm 370 is coupled to the shroud 320 between the forward end 324 and aft end 326. The shroud arm 370 may be coupled to the shroud 320 at any point between the forward end 324 and aft end 326. In some embodiments the shroud arm 370 may be coupled to the shroud 320 at a midpoint between the forward end 324 and aft end 326, and/or may be coupled to the shroud 320 at the knee 328. Coupling the shroud arm 370 to shroud 320 at the knee 328 allows close control of the clearance gap 140 at the knee 328.

The shroud arm 370 divides the generally annular region that is radially outward and axially forward of the shroud 320 into a first cavity 380 and second cavity 382. The first cavity 380 is an inlet-side cavity and may be in fluid communication with the inlet 346. First cavity 380 may therefore be at a first pressure $P_1$. The first cavity 380 may be at least partially bound by the shroud 320 and shroud arm 370.

The second cavity 382 is an outlet-side cavity and may be in fluid communication with the outlet 347. Second cavity 382 may therefore be at a second pressure $P_2$. The second pressure $P_2$ may be the discharge pressure of the centrifugal impeller 111. The second cavity 382 may be at least partially bound by the shroud 320 and shroud arm 370. In embodiments having a flexible portion 372 with a U-shaped cross section, an inner concave surface 383 of the U shape may be in fluid communication with the second cavity 382.

The differential pressure across the centrifugal compressor 100 may be proportional to the rotational speed of the centrifugal impeller 111. Therefore, the pressure difference between the first cavity 380 and the second cavity 382 may also be proportional to the rotational speed of the centrifugal impeller 111. Since a portion of the deflection experienced by the centrifugal impeller 111 during operation is due to mechanical and pressure loading, the differential pressure across the shroud arm 370 (i.e. between the first cavity 380 and the second cavity 382) may be proportional to that loading.

Although the shroud arm 370 is illustrated with a flexible portion 372 having a U-shaped cross section, the present disclosure is not so limited. The shape, thickness, radius, positioning, size, and connection points of the shroud arm 370 and flexible portion 372 may be altered to achieve a desired performance.

In some embodiments, one or more sensors 385 may be used to monitor the clearance gap 140. Such sensors 385 may be embedded in the shroud 320 for directly sensing the clearance gap 140, or may comprise various systems for indirectly sensing the clearance gap 140.

During operation, the shaft 116 is rotated at a high speed. Centrifugal impeller 111 and blades 112 are rotated with the shaft 116. Gas (e.g., air) is drawn from the inlet 346, through the rotating blades 112, and discharged at a higher pressure to the outlet 347. In some embodiments gas received at the inlet 346 of the centrifugal compressor 100 is the discharged gas of an axial compressor. The high speed rotation of the centrifugal impeller 111 and thermal heating of the centrifugal compressor 100 during operation cause the shape changes described above with reference to FIG. 2, namely the expansion and contraction of the centrifugal impeller 111 itself and the deflection of the exducer 117.

The centrifugal impeller 111 comprises a third material or combination of materials and has a third coefficient of thermal expansion ($\alpha_3$). In some embodiments, the centrifugal impeller 111 may comprise a nickel alloy, titanium or titanium alloy, Inconel, Udimet, RR1000, or steel. In some embodiments the third coefficient of thermal expansion is the same or substantially the same as the second coefficient of thermal expansion. In some embodiments, the thermal member 360 expands responsive to increasing temperatures to a similar extent as the centrifugal impeller 111.

Figure 4:
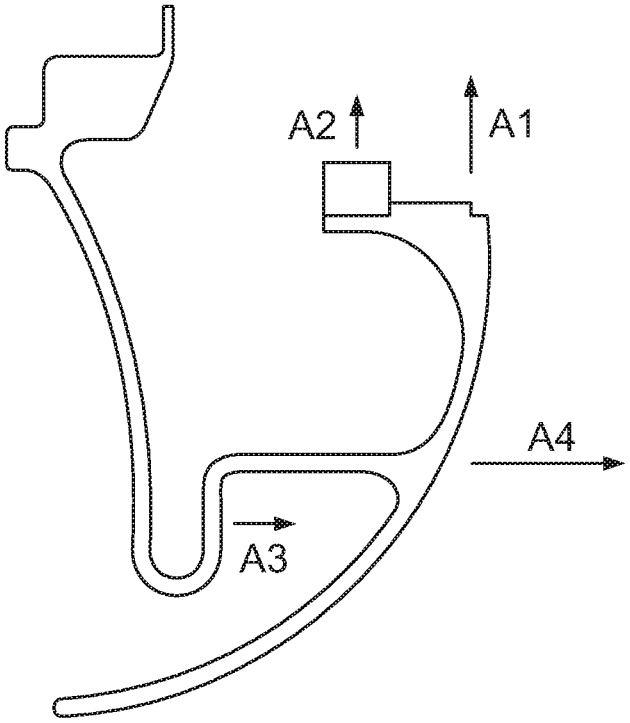
FIG. 4 is a simplified cross-sectional view of a compressor shroud assembly in accordance with some embodiments of the present disclosure.
Figure 5:
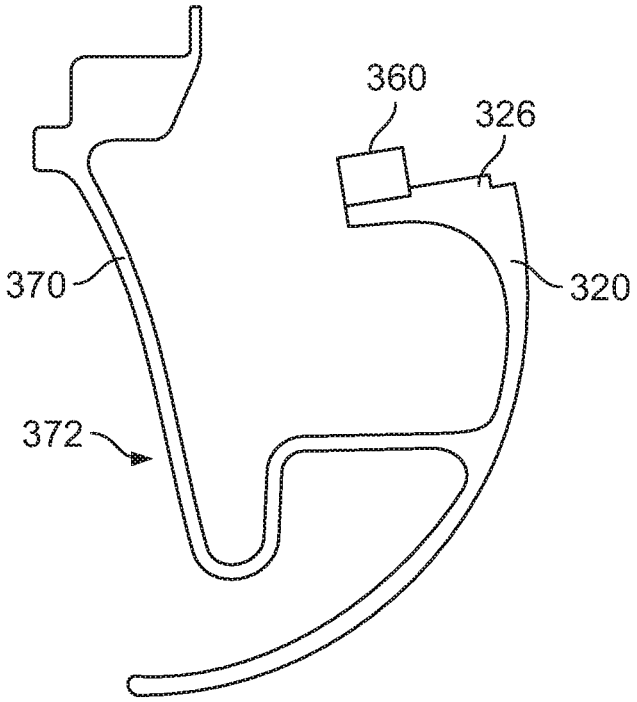
FIG. 5 is a simplified cross-sectional view of a compressor shroud assembly in accordance with some embodiments of the present disclosure.

Responsive to the pressure and temperature changes caused by operation of the centrifugal compressor 100, the centrifugal impeller shroud assembly 300 is configured to alter the shape and/or position of the shroud 320 relative to the centrifugal compressor 100. Such changes in shape and/or position maintain the blade tip clearance 140 and resolve misalignment between the shroud 320 and centrifugal impeller 111 to ensure continued safe and efficient operation of the centrifugal compressor 100. FIG. 4 illustrates a simplified cross-sectional view of the centrifugal impeller shroud assembly 300 with indications of potential movement of the shroud 320, and FIG. 5 presents a simplified cross-sectional view of the changes to the centrifugal impeller shroud assembly 300 during operation of the centrifugal compressor 100.

Increasing temperatures caused by operation of the centrifugal compressor 100 causes the shroud 320 to expand. The thermal member 360, having a lower thermal coefficient of expansion than the shroud 320, expands less than the shroud 320. The difference between the extent to which the shroud 320 and thermal member 360 expands results in deflection of the aft end 326. The deflection of the aft end 326 of shroud 320 caused by lesser expansion of the thermal member 360 is shown in FIG. 5.

In some embodiments, the higher the temperatures experienced by the shroud 320 due to operation of the centrifugal compressor 100, the greater the degree of deflection of the aft end 326. Thermal member 360, shroud 320, and aft end 326 are subject to temperature changes based on exposure to the gasses flowing through the centrifugal compressor 100. Thermal member 360 and aft end 326 are exposed to gasses exiting the centrifugal compressor 100 at outlet 347, and are therefore heated to be generally at the operating temperatures of those gasses.

In some embodiments the thermal member 360 comprises a material that restricts thermal growth as compared to the material of the shroud 320. In some embodiments the thermal member 360 creates a moment about the aft end 326 of the shroud 320 by having a lower thermal growth than the shroud 320.

Expansion of the shroud 320 in the radial direction is illustrated by Arrow A1 in FIG. 4, while expansion of the thermal member 360 in the radial direction is illustrated by Arrow A2. The mismatch between the extent of thermal expansion (roughly illustrated in the mismatch between the size of Arrow A1 to Arrow A2) causes deflection of the aft end as illustrated in FIG. 5. With the shroud moving axially aft (as described below), the net effect of the deflection is to position the aft end 326 axially forward and, in some embodiments, radially inward from the position it would otherwise assume without the deflection caused by the thermal member 360. The deflection may comprise a curling motion of the shroud 320. The deflection caused by thermal member 360 allows the aft end 326 of the shroud 320 to closely match the deflection of the centrifugal impeller 111 of the centrifugal compressor 100 caused by operation, thus resolving misalignment between these components.

The pressure differential across the centrifugal compressor 100 during operation results in a pressure differential between first cavity 380 and second cavity 382. This pressure differential causes flexion of the flexible portion 372, which in turn drives axial movement of the shroud 320. In FIG. 4, Arrow A3 illustrates the flexion of the flexible portion 372 and axially aft motion of the shroud arm 370 resulting from that flexion. Arrow A4 illustrates the axially aft motion of the shroud 320. The axial movement or repositioning of the shroud 320 due to flexion of the flexible portion 372 of shroud arm 370 is illustrated in FIG. 5.

In embodiments having a flexible portion 372 with a U-shaped cross section, such as the embodiments illustrated in FIGS. 3-5, the higher pressure of second cavity 382 acts on the inside of the U-shaped cross section to force the opposing sides of the U open, thus imparting an axial movement to the shroud arm 370 and shroud 320.

Although the arrows of FIG. 4 illustrate the changes in shroud 320 shape and positioning between a cold, unoperating condition of the centrifugal compressor 100 and a hot, operating condition, it is apparent that changes from operation to shutdown will have a reverse effect. The shroud 320 will thermally contract to a greater extent than the thermal member 360, and the flexible portion 372 will tense to cause axially forward movement of the shroud arm 370 and shroud 320. Further, when the centrifugal compressor 100 is operating any temperature and pressure transients or changes will be reflected by motion of the shroud 320 based on changes to the thermal member 360 and shroud arm 370.

The present disclosure therefore provides both thermally- and mechanically-driven mechanisms for passive control of the shape and positioning of the shroud 320. A thermal member 360, having a lower coefficient of thermal expansion than the shroud 320, expands less than the shroud when subject to operating temperatures and therefore causes deflection of the aft end 326. The thermal member 360 provides a thermally-driven mechanism for maintaining the clearance gap 140 during operation of the centrifugal compressor 100. A shroud arm 370 having a flexible portion 372 couples the shroud 320 to a static casing 371. The differential pressure across the shroud arm 370, caused by the differential pressure across an operating centrifugal compressor 100, results in axial movement or repositioning of the shroud 320. The shroud arm 370 provides a mechanically-driven mechanism for maintaining the clearance gap 140 during operation of the centrifugal compressor 100. In some embodiments, the thermally-driven mechanism—the thermal member 360—primarily maintains the clearance gap 140 and resolves misalignment during steady-state operating conditions, while the mechanically-driven mechanism—the shroud arm 370—primarily maintains the clearance gap 140 and resolves misalignment during transient operations.

The provision of both thermal and mechanical mechanisms for adjusting the shape and/or position of the shroud 320 is important because the deflection of the centrifugal impeller 111 as described with reference to FIG. 2 is caused by both thermal and mechanical loading of the centrifugal impeller 111. In some centrifugal impellers 111 the thermal loading, and particularly the temperature difference across or through the centrifugal impeller 111, may account for up to two thirds of the centrifugal impeller deflection. The remaining centrifugal impeller deflection is accounted for by centrifugal and pressure loading of the centrifugal impeller 111.

Figure 6:
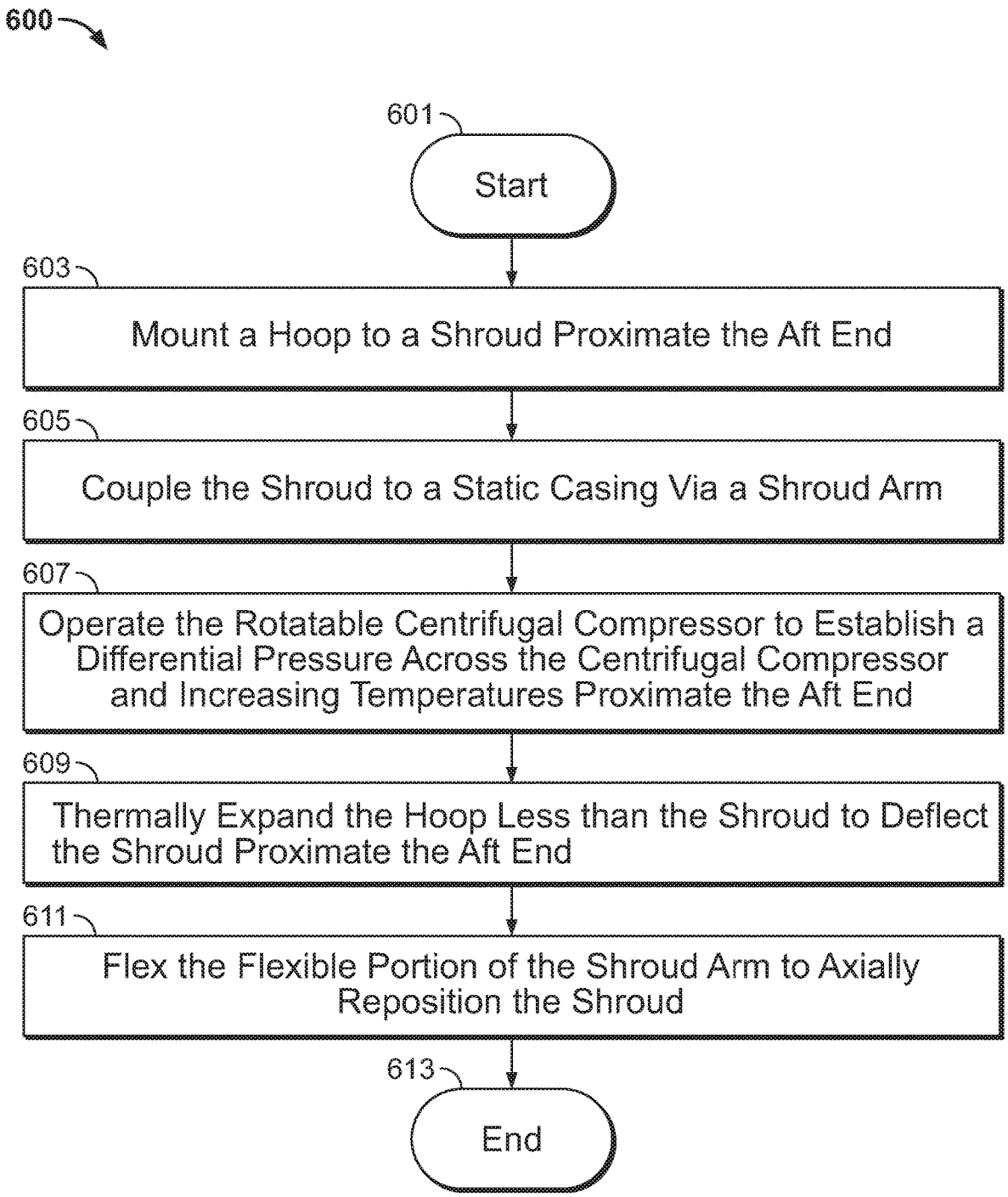
FIG. 6 is a flow diagram of a method in accordance with some embodiments of the present disclosure.

In addition to disclosing the systems described above, the present disclosure provides a method of dynamically changing the shape and/or position of a centrifugal compressor shroud 320. FIG. 6 provides a flow diagram of a method 600 in accordance with some embodiments of the present disclosure.

Method 600 starts at Block 601. At Block 603, a thermal member 360 is mounted to a shroud 320 proximate the aft end 326. The thermal member 360 may be mounted to the shroud 320 via a coupling member 327. The thermal member 360 expands less than the shroud 320 responsive to increasing temperatures. The material of the thermal member 360 may be selected to thereby effect thermal deflection of the discharge end 326 of the boundary member in a manner similar to the thermal expansion of the discharge end 151 of the centrifugal impeller 111 during operation of the centrifugal impeller 111.

At Block 605, the shroud 320 is coupled to a static casing 371 by a shroud arm 370. The shroud arm 370 may comprise a flexible portion 372 that may have a U-shaped cross section. The shroud arm 370 may divide a first cavity 380 from a second cavity 382. The flexion of the flexible portion 372 of the shroud arm 370 may be selected to thereby effect axial movement of the knee portion 328 of the boundary member in a similar manner to the axial movement of the centrifugal impeller 111 responsive to changes in the differential pressure from the inlet end 115 to the discharge end 151 of the centrifugal impeller 111 during operation of the centrifugal impeller 111.

The centrifugal compressor 100 is then operated at Block 607, indicating that the rotatable centrifugal impeller is rotated. Operation of the centrifugal compressor 100 establishes a differential pressure across the centrifugal compressor 100 and increasing temperatures throughout the centrifugal compressor 100 and shroud 320, including proximate the aft end 326.

At Block 609 the thermal member 360 is expanded less than the shroud 320 responsive to the increasing temperatures, resulting in deflection of the shroud 320 proximate the aft end 326. The deflection may comprise a curling motion of the shroud 320 and/or aft end 326. In this step the discharge end 326 of the boundary member is deflected responsive to changes in the temperature of the fluid at the discharge end 326 by mounting a thermal member 360 to the shroud 320 proximate the discharge end 326 of the boundary member. The thermal member 360 comprises a material having a coefficient of thermal expansion (CTE) that is lower than the CTE of the shroud 320.

The flexible portion 372 is flexed at Block 611. Flexing the flexible portion 372 axially repositions the shroud 320. The flexible portion 372 flexes responsive to changes in differential pressure between first cavity 380 and second cavity 382. In this step the knee portion 328 of the boundary member is axially moved responsive to changes in the differential pressure between the fluid at the inlet end 324 and the fluid at the discharge end 326 of the boundary member by coupling the shroud 320 to a static casing 371 via a shroud arm 370. The shroud arm 370 has a flexible portion 372 configured to flex responsive to a differential pressure between the inlet end 324 and the discharge end 326 of the shroud 320.

The method may further comprise preventing further axial repositioning in an axially aft direction by engaging a receiving groove 329 of the shroud 320 with an outlet flowpath member 345. The method may further comprise sensing a clearance gap 140 between the shroud 320 and centrifugal compressor 100. The clearance gap 140 may be sensed with sensors 385. The method may further comprise deflecting the aft end 326 of the shroud 320 responsive to changes in the temperature of gasses exiting the centrifugal compressor 100 during operation. The method may further comprise axially repositioning the shroud 320 responsive to changes in differential pressure across the centrifugal compressor 100 during operation.

The method ends at Block 613.

The disclosed subject matter provides numerous advantages over the prior art. Notably, the disclosed systems and methods passively maintain the clearance gap and resolve misalignment between a rotatable centrifugal impeller and an impeller shroud. As discussed above, the change from an active clearance control system to a passive clearance control system greatly simplifies the design and operation of the centrifugal compressor, and removes the need for many complicated linkages and systems that contribute significant weight and/or require a significant amount of power to operate.

Maintaining an appropriately-sized clearance gap ensures safe and efficient operation of the centrifugal compressor, and the turbine engine as a whole. A dynamically moveable impeller shroud also improves operability of the centrifugal compressor by providing a wider range of efficient operating conditions. Minimizing the clearance gap provides increased centrifugal compressor performance and lower fuel consumption.

The disclosed subject matter of a thermal member and flexible shroud arm provides a system that is responsive to both thermal and mechanical changes in the operating environment. Further, the disclosed thermal member coupled proximate the aft end of the shroud approximates or closely matches the deflection experienced by a centrifugal impeller during operation. The disclosed systems and methods therefore allow for maintaining an appropriately-sized gap through the entire length of the shroud (i.e. from the forward end to the aft end), whereas the prior art typically requires monitoring and adjusting the clearance gap based only on a single or few points along the shroud. For example, in prior art systems that monitor and optimize the clearance gap at the knee, both excessive and/or insufficient clearance gaps may occur at the aft end of the shroud. In the disclosed systems and methods, the flexible shroud arm may be the primary driver to maintaining an effective clearance gap at the knee, while the thermal member may be the primary driver for maintaining an effective clearance gap at the aft end or exducer.

The disclosed systems and methods not only provide mechanisms for adjusting shroud shape and/or position based on thermal and mechanical loading of the centrifugal impeller, but allow those mechanisms to operate somewhat independently of each other. The temperature changes used as an input to adjust the aft end deflection of the shroud only minimally impacts the differential pressure across the shroud arm. Similarly, the differential pressure across the shroud arm that is used as an input to adjust the axial positioning of the shroud only minimally impacts the temperatures changes proximate the thermal member. The thermal and mechanical loading are therefore largely isolated from each other and the shroud is passively designed to respond to each at a different rate of speed and in a different manner.

Although the above description is directed to a centrifugal compressor, and more particularly to a centrifugal compressor in a gas turbine engine, the systems, methods, and principles disclosed herein are equally applicable to passive clearance control for a centrifugal impeller shroud in additional applications, such as a centrifugal pump.

Although examples are illustrated and described herein, embodiments are nevertheless not limited to the details shown, since various modifications and structural changes may be made therein by those of ordinary skill within the scope and range of equivalents of the claims.

What is claimed is:

1. A centrifugal impeller shroud assembly having a dynamically moveable impeller shroud for encasing a rotatable centrifugal impeller and resolving misalignment between the impeller shroud and the rotatable centrifugal impeller, said assembly comprising:

a static casing;

an impeller shroud facing the rotatable centrifugal impeller and extending from an inlet to an outlet;

a shroud arm coupled between the casing and the impeller shroud, the shroud arm comprising a flexible portion, the shroud arm and impeller shroud at least partially defining a first cavity in fluid communication with the inlet and a second cavity in fluid communication with the outlet, the flexible portion being configured to flex responsive to a differential pressure between the first cavity and the second cavity; and a thermal member coupled to the impeller shroud proximate the outlet, the thermal member having a coefficient of thermal expansion (CTE) lower than the CTE of the shroud.

2. The impeller shroud assembly of claim 1 wherein flexion of said flexible portion of the shroud arm effects axial movement of the impeller shroud.

3. The impeller shroud assembly of claim 1 wherein said flexible portion of the shroud arm comprises a U-shaped cross section when viewed normal to an axis of rotation of the centrifugal impeller, wherein a concave surface of the U-shaped cross section is in communication with the second cavity.

4. The impeller shroud assembly of claim 1 wherein said shroud arm is coupled to the impeller shroud at a knee of the shroud.

5. The impeller shroud assembly of claim 1 wherein said second cavity is exposed to fluid at the impeller discharge pressure.

6. The impeller shroud assembly of claim 1 wherein said first cavity is exposed to fluid at the impeller inlet pressure.

7. The impeller shroud assembly of claim 1 wherein the thermal member effects deflection of the shroud proximate the outlet, said deflection responsive to changes in temperature.

8. The impeller shroud assembly of claim 7 wherein movement and deflection of the shroud resolves misalignment between the shroud and the centrifugal impeller.

9. The impeller shroud assembly of claim 1 wherein the thermal member has a CTE substantially the same as the CTE of the centrifugal impeller.

10. The impeller shroud assembly of claim 1 further comprising a static member positioned to limit aft movement of the shroud.

11. A centrifugal impeller shroud assembly having a dynamically moveable impeller shroud for encasing a rotatable centrifugal impeller and resolving misalignment between the shroud and the rotatable centrifugal impeller, said assembly comprising:

a shroud extending between a forward end proximate an inlet and an aft end proximate an outlet;

a thermal member coupled to said shroud proximate the aft end of the shroud, the thermal member comprising a material having a lower coefficient of thermal expansion (CTE) than the material of said shroud to thereby effect deflection of the aft end of the shroud responsive to changes in temperature; and a shroud arm coupled between the shroud and a static casing, the shroud arm comprising a flexible portion that flexes responsive to a pressure differential across said shroud arm to thereby effect axial movement of the shroud responsive to changes in the differential pressure across said shroud arm.

12. The impeller shroud assembly of claim 11 wherein said shroud comprises an impeller-facing member and a coupling member extending forward from said impeller-facing member, the thermal member being coupled to the shroud via the coupling member.

13. The impeller shroud assembly of claim 11 further comprising a static member positioned to limit aft movement of said aft end of the shroud.

14. The impeller shroud assembly of claim 11 wherein the thermal member comprises one or more of nickel alloy, Inconel, titanium, or low-a steel.

15. The impeller shroud assembly of claim 11 wherein the shroud arm is coupled to the shroud approximate a midpoint between the forward end and the aft end.

16. The impeller shroud assembly of claim 11 wherein said flexible portion of the shroud arm comprises a U-shaped cross section when viewed normal to an axis of rotation of the centrifugal impeller.

17. The impeller shroud assembly of claim 11 wherein movement and deflection of the shroud resolves misalignment between the shroud and the centrifugal impeller.

18. A method of dynamically changing the shape of a shroud encasing a centrifugal impeller, the shroud comprising a boundary member extending from an inlet end to a discharge end, the method comprising:

deflecting the discharge end of the boundary member responsive to changes in the temperature of the fluid at the discharge end by mounting a thermal member to the shroud proximate the discharge end of the boundary member, the thermal member comprising a material having a coefficient of thermal expansion (CTE) that is lower than the CTE of the boundary member; and axially moving a knee portion of the boundary member responsive to changes in the differential pressure between the fluid at the inlet end and the fluid at the discharge end of the boundary member by coupling the shroud to a static casing via a shroud arm, the shroud arm having a flexible portion configured to flex responsive to a differential pressure between the inlet end and the discharge end of the boundary member.

19. The method of claim 18 comprising selecting the material of the thermal member to thereby effect thermal deflection of the discharge end of the boundary member in a manner similar to the thermal expansion of the discharge end of the centrifugal impeller during operation of the centrifugal impeller.

20. The method of claim 18 comprising selecting the flexion of the flexible portion of the shroud arm to thereby effect axial movement of the knee portion of the boundary member in a similar manner to the axial movement of the centrifugal impeller responsive to changes in the differential pressure from the inlet end to the discharge end of the centrifugal impeller during operation of the centrifugal impeller.

* * * * *